United States Patent [19]

Scheindel

[11] Patent Number: 4,913,323

[45] Date of Patent: Apr. 3, 1990

[54] STEPPED PISTON FOR PRESSURE OPERATED DISPENSING CONTAINER

[75] Inventor: Christian T. Scheindel, Randolph Center, Vt.

[73] Assignee: Schneindel Associates, Inc., Randolph Center, Vt.

[21] Appl. No.: 361,752

[22] Filed: Jun. 5, 1989

Related U.S. Application Data

[63] Continuation of Ser. No. 912,670, Sep. 29, 1986, abandoned, which is a continuation of Ser. No. 727,433, Apr. 26, 1985, abandoned, which is a continuation-in-part of Ser. No. 529,577, Sep. 6, 1983, abandoned.

[51] Int. Cl.[4] ..... B67D 5/42

[52] U.S. Cl. ..... 222/386; 222/389; 92/239

[56] References Cited

U.S. PATENT DOCUMENTS

| | | | |
|---|---|---|---|
| 3,099,370 | 7/1963 | Hein | 222/386.5 |
| 3,132,570 | 5/1964 | Hoffman, Jr. et al. | 92/245 X |
| 3,273,762 | 9/1966 | O'Neill, Jr. | 222/389 |
| 3,381,863 | 5/1968 | Towns | 222/389 X |
| 3,407,974 | 10/1968 | Chmielowiec | 222/389 X |
| 3,915,352 | 10/1975 | Scheindel | 222/389 |
| 4,023,717 | 5/1977 | Schultz | 222/389 X |

FOREIGN PATENT DOCUMENTS

| | | | |
|---|---|---|---|
| 981552 | 1/1965 | United Kingdom | 222/389 |

*Primary Examiner*—Kevin P. Shaver
*Assistant Examiner*—Gregory L. Huson
*Attorney, Agent, or Firm*—McAulay Fisher Nissen & Goldberg

[57] ABSTRACT

A piston is longitudinally slidable within a pressurized container to dispense materials from the container. The piston has a generally annular sidewall and a traverse barrier wall at one end of the sidewall and integral therewith to define a cup-shaped closure open at one end. An annular step is provided on the sidewall which divides the sidewall into two segments, an upper segment and a lower segment. The annular step is below and spaced from the barrier wall. The upper segment has a diameter smaller than the diameter of the lower segment and the clearance between the upper segment and the interior of the container is substantially greater than the clearance between the lower segment and the interior of the container.

7 Claims, 2 Drawing Sheets

STEPPED PISTON FOR PRESSURE OPERATED DISPENSING CONTAINER

REFERENCE TO RELATED APPLICATION

This application is a continuation of application Ser. No. 912,670, filed 9/29/86 now abandoned, which is a continuation of application Ser. No. 727,433, filed Apr. 26, 1985, and now abandoned, which is a continuation-in-part of U.S. patent application Ser. No. 529,577 filed Sept. 6, 1983 and now abandoned and entitled Rigid Pressurized Container Piston.

BACKGROUND OF THE INVENTION

The invention relates to a piston usable in a pressure operated dispensing container.

Pressure operated dispensing containers which utilize a piston longitudinally slidable within the container are known in the prior art. These pressurized containers are used to dispense a variety of different materials of varying viscosities. The containers generally include a cylindrical can closed at one end and provided with a dispensing spout under the control of a valve. The opposite end of the container is sealed.

The piston is received within the container and serves to separate the container into two chambers. The product to be dispensed occupies the upper chamber, above the piston. A pressurized fluid which acts as a propellant, occupies the lower chamber, below the piston. The piston is roughly in the form of an inverted cup and has an upper and an annular skirt or sidewall which extends down from the upper surface. The upper surface acts as a barrier to separate the product and the propellant. The annular sidewall of the piston stabilizes and positions the piston in the container and provides a surface which rides on the inner wall of the container.

The product to be dispensed is loaded into the upper chamber of the container under pressure. The loading is a three stage operation. Each stage occurs at a different index position on the loading machine. During the first stage, known as the fill stage the product is introduced into the can above the top of the piston. During the second stage, known as the pressure stage a pressure differential is created above and below the piston to force some of the product down around the periphery of the piston between the piston sidewall and the container. During the third stage, known as the pushup stage, the piston is pushed toward the top of the container. This pushup stage also causes product to seep down around the periphery of the piston. After the loading of the product into the upper chamber is completed, propellant is loaded into the lower chamber under pressure. In use, when the valve at the top of the container is opened, the propellant pushes the piston toward the top of the container through the valve.

Prior art pistons have not been entirely satisfactory during both the loading of the pressurized container and during the dispensing of the product therefrom. During the pressure stage of the loading operation these pistons have tended to buckle-in, deform and tilt causing (a) loss of product down one side of the piston into the bottom of the container and (b) lack of seal on the other side of the piston resulting in excessive secondary permeation and/or bypass.

In loading a pressurized container it is cost-efficient to do so at high speed and using high pressure. Heretofore, the aforementioned problems with piston tilt and deformation have been avoided by loading containers at a less than efficient speed and/or pressure.

After the container is loaded the piston must be able to maintain the seal between its sidewall and the inner surface of the wall of the container. It must minimize secondary permeation which is diffusion of propellant around the piston at the propellant-product interface. This secondary permeation allows propellant and product to mix and thus decreases product shelf life and otherwise adversely affects the product. Further, during dispensing of the product, it is important that the piston minimize the bypass of propellant around the piston skirt into the product.

Piston skirt length is a function of container diameter. Although a piston which provides little clearance between itself and the container inner wall decreases secondary permeation, this type of fit increases bypass. As the piston diameter approaches that the container thereby decreasing clearance, the likelihood of secondary permeation around the piston obviously lessens. Further, for purpose of decreasing this secondary permeation the longer the length of a tight fitting piston the better. However, a piston which provides little clearance over a distance also increases resistance to movement. The increased resistance to movement results in increased bypass when the container valve is first opened. Accordingly, the most effective piston is one which has a diameter capable of minimizing secondary permeation without concomitantly creating a bypass problem within the confines of the piston length necessitated by the particular can.

An object of the present invention is to provide a piston which does not deform, tilt or shift when product is loaded into a container at high speed and under high pressure.

Yet another object of the present invention is to provide a piston which will minimize both secondary permeation and bypass.

A further object of the present invention is to provide such a piston as which will facilitate even distribution of product between the sidewalls of the piston and container.

BRIEF DESCRIPTION

In brief, one embodiment of the invention involves a piston having a dual diameter sidewall. A first portion of the sidewall provides a relatively close clearance with the inner wall of the container and a second portion of the sidewall provides a substantially greater clearance. In particular, the piston has a generally cylindrical sidewall with a transverse barrier wall at the upper end of the sidewall. The upper barrier wall and the sidewall define a generally inverted cup-shaped structure. The sidewall has an annular step which divides the sidewall into an upper segment and a lower segment. The lower sidewall segment has an outer diameter which is greater than the outer diameter of the upper sidewall segment. Thus the upper sidewall segment provides substantially greater clearance between itself and the interior wall of the container than does the lower sidewall segment. For example, the clearance between the lower sidewall segment and the container sidewall might be 5 mils (0.127 mm) and the clearance between the upper segment of the side of the piston sidewall and the container wall might be 25 mils (0.635 mm).

With such relative clearances, during the loading operation, the material with which the containers are being loaded will more readily distribute itself all around the piston sidewall and the gap between the upper portion of the sidewall and the container than would be the case where the clearance to the lower sidewall extended all the way up. In this example, the cross-sectional access area through which the material is pushed is 5 times greater adjacent to the upper portion of the sidewall than it is adjacent to the lower portion of the sidewall. Accordingly, it is possible to much more rapidly fill the can without shifting, tilting or folding-in the piston than is the case with prior art unstepped pistons.

DESCRIPTION OF THE PREFERRED EMBODIMENTS

Figure 1:
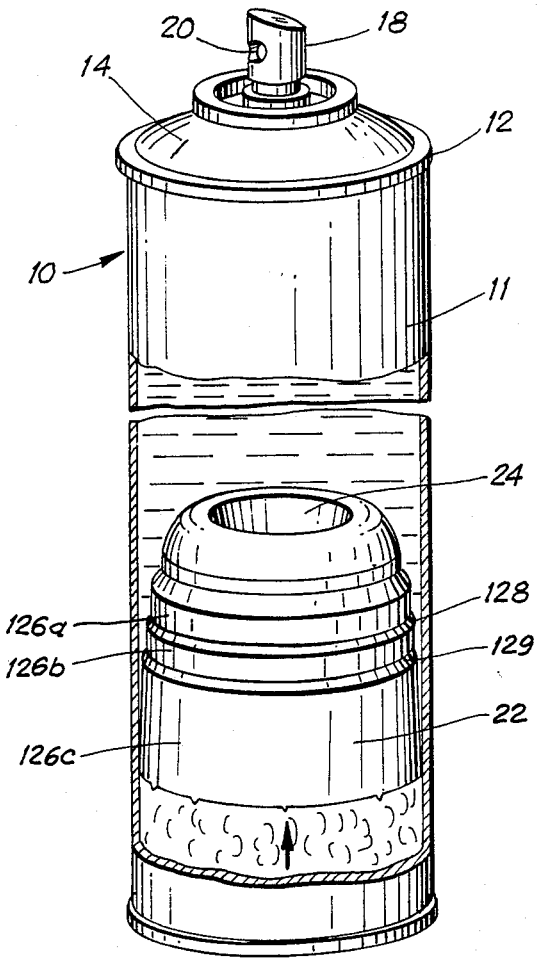
FIG. 1 is a side elevation view, partially broken away of a pressurized container having a stepped piston in accordance with the present invention.
Figure 2:
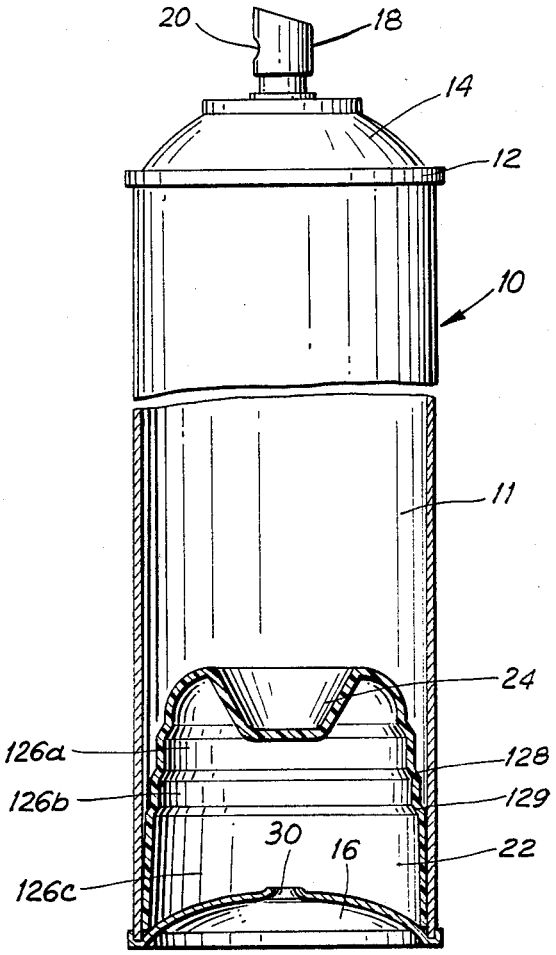
FIG. 2 is a fragmentary view similar to FIG. 1 partially in vertical cross-section.
Figure 3:
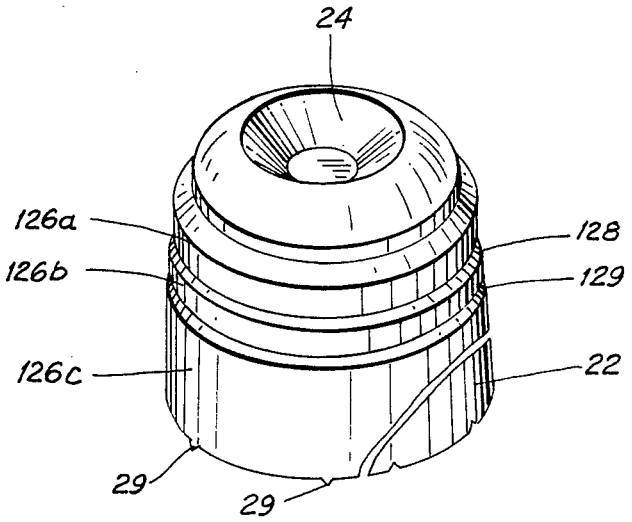
FIG. 3 is a somewhat isometric view of the FIG. 1 piston.

Referring to the drawings, the reference numeral 10 denotes a pressurized container for dispensing materials. Container 10 is usable with materials of varying viscosities and depending upon the piston sidewall clearance and piston material can be used to dispense materials having a viscosity up to 2,000,000 centipoise (cps). Container 10 includes a substantially cylindrical body 11 closed at its dispensing end 12 by a cap 14 and at the other end by a bottom wall 16 all of which are secured together and sealed with liquid-tight integrity. A dispensing nozzle 18 is carried in cap 14 and includes valve means (not shown), well-known in the art. When nozzle 18 is depressed the contents of container 10 may escape through orifice 20 in nozzle 18.

A piston 22 is provided. Piston 22 is longitudinally slidable within container 10. Piston 22 includes a generally annular sidewall 26 which is closed at its upper end by a barrier wall 24. The barrier wall 24 is generally shaped to conform to the inner top surface of container 10 and to accomodate the valve assembly.

Piston 22 is formed with at least one annular step 28 on its sidewall 26. Step 28 is below and spaced from barrier wall 24. Step 28 divides sidewall 26 into two segments, an upper segment **26*a* and a lower segment 26*b*. The diameter of upper segment 26*a* is smaller than the diameter of lower segment 26*b*. This difference in diameter is such that the clearance between upper segment 26*a* and the interior of cylindrical body 11 is substantially greater than the clearance between the lower segment 26*b* and the interior of cylindrical body 11**.

Preferably, the clearance between upper segment **26*a* and the cylindrical body 11 is at least four times greater than the clearance between lower segment 26*b* and the interior of cylindrical body 11. Accordingly, the access area between upper segment 26*a* and the interior of cylindrical body 11 is substantially greater than the access area between lower segment 26*b* and the interior of cylindrical body 11**.

The relative clearances and access ratios provided by the annular step and the upper and lower segment are useful to permit the pressure step of the loading operation to proceed at a high speed without a significant failure rate. The clearance differential and access ratio encourage the product to be pushed around the piston sidewall 26 and between the sidewall and the container more evenly than heretofore. This is especially significant when more viscous products are being loaded into the container. The even distribution avoids problems with piston fold-in, tilt and shift which adversely affect the seal around the piston and increase bypass problems.

For each given container there is a minimum length that piston 22 can be. This minimum length is a function of the container diameter. For example, a container having a diameter of about two inches (5 cm.) must have a piston with a skirt length of about at least 1.5 inches (3.8 cm.). A shorter piston would tend to tilt, flip and otherwise cause problems during discharge of product from the container.

When a piston such as piston 22 with its annular step 28 is utilized, the relative lengths and diameters of the upper and lower segments must be determined with reference to both the aforementioned minimum piston length and considerations of secondary permeation and bypass. Lower segment **26*b* is designed to have a length and diameter that in combination provide a tightness of fit that minimizes secondary permeation. However, a point is reached where the fit between piston lower skirt segment 26*b* and container sidewall 11 creates bypass problems. Thus the segment 26*b* will have a length less than the minimum length required for the sidewall and the segment 26*a* will make up for the rest of that required skirt length. In practice the relative dimension of segment 26*a* and 26*b* are determined as follows. For a given container diameter one determines the maximum height and diameter of lower segment 26*b* usable before bypass problems will occur. The length and diameter of upper segment 26*a*** then are determined with reference to the minimal piston length and the above-described clearance and area access ratios.

Piston 22 may be constructed to have a sidewall of various different thicknesses and may also differ in sidewall flexibility. Depending on the particular piston used and the material to be dispensed from the container, the clearances between the piston segments and the interior of the container body will differ.

By way of example, one stepped piston, constructed in accordance with the present invention, provides a clearance between its upper segment **26*a* and the interior cylindrical body 11 of about 50 mils (1.27 mm) while providing a clearance between its lower segment 26*b* and the interior of cylindrical body 11 of about 10 mils (0.254 mm). In this example the lengths of segments 26*a* and 26*b* are about the same. This piston would be utilized with more viscous materials. Further, by way of example, another piston built in accordance with the present invention provides a clearance between its upper segment 26*a* and the interior of cylindical body 11 of about 10 mils (0.254 mm) while providing a clearance between its lower segment 26*b* and the interior of cylindrical body 11 of about 2 mils (0.508 mm). In this example the ratio of the lengths of segment 26*a* and 26*b*** is about 9 to 1. This piston would be utilized with less viscous material.

As shown in FIGS. 1–4 and 6, piston 22 can be formed with two spaced apart annular steps 128 and 129 to thus divide the annular sidewall into three segments, 126*a* and 126*b* and 126*c*. Although this two stepped embodiment can be used with any product, it is intended for use very viscous products. The segments are graduated in diameter with the smallest diameter segment 126*a* being the upper segment and closest to the barrier wall. In one example of a two stepped three segment piston, the clearance between the lowest annular sidewall segment 126*c* and the container sidewall is about 5 mil (0.127 mm), the clearance between the middle annular sidewall 126*b* segment and the container sidewall is about 45 mil (1.143 mm), and the clearance between the upper annular sidewall segment 126*a* and the container sidewall is about 65 mil (1.654 mm). In this example the lengths of segments 126*a* and 126*b* are about equal while segment 126*c* is about four times greater in length than either segment 126*a* or 126*b*.

Piston 22 may be either injection molded or thermoformed. If an injection molded piston is used, as is traditional in the art, the piston is provided with a sidewall taper of about 1°.

A series of spaced nibs 29 may be provided. These nibs 29 extend down from the bottom edge of the piston 22 to facilitate the escape of gases under the piston during the loading process and to prevent the bottom of the piston from becoming wedged against the bottom wall of the container during loading.

Figure 4:
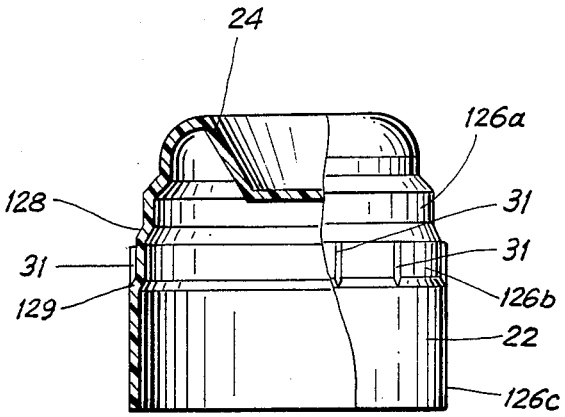
FIG. 4 is a side elevation view, partially in cross-section, of another embodiment of the stepped piston in accordance with the present invention.
Figure 5:
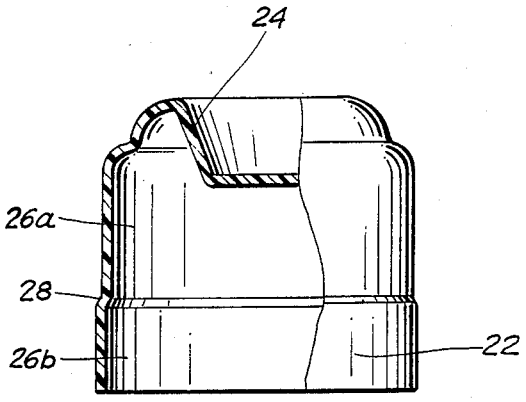
FIG. 5 is a view analogous to FIG. 5 showing another embodiment of a stepped piston in accordance with the present invention.
Figure 6:
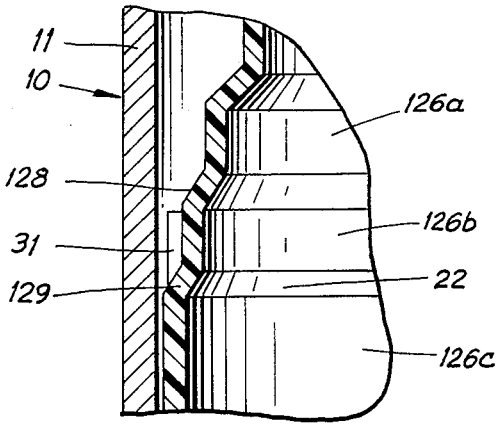
FIG. 6 is a fragmentary sectional view showing the FIG. 4 piston in a pressurized container.
Figure 7:
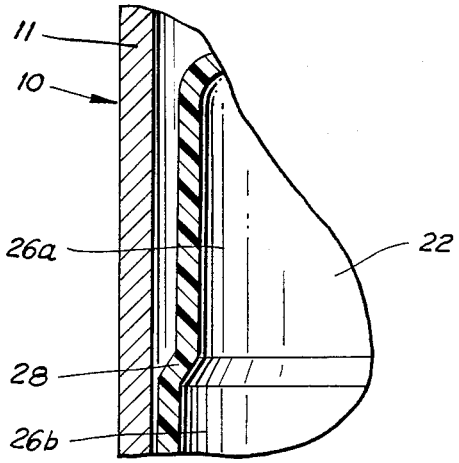
FIG. 7 is a view analogous to FIG. 4 showing the FIG. 5 piston in a pressurized container.

Additionally, a plurality of longitudinal, circumferentially spaced apart radially extended ribs 31 may be provided on any segment but the lowest segment of the piston to stabilize the piston and help prevent tilting of piston during loading. The ribs 31 will normally extend out to a diameter equal to that of the piston segment immediately below the segment that they are on. For example, as shown in FIG. 4, the ribs 31 are on middle segment 126*b* and extend out to a diameter equal to that of lower segment 126*c*. The ribs are more important in embodiments where highly viscous materials are to be dispensed and thus the upper-most segment is designed for substantial clearance.

Container 10 is loaded through the opening in the cap which receives the valve and nozzle member 18. Subsequent thereto, the valve and dispensing nozzle are inserted.

The bottom of container 10 is initially provided with an opening 30 through which air under the piston 22 may be forced out. After the product is loaded into the container, a suitable propellant, under pressure, is applied to the interior of the piston. This forces piston 22 in the direction of the dispensing nozzle and against the product. At that point, the opening 30 in the container bottom is sealed and the pressurized container is ready for use.

What is claimed:

1. A pressurized piston operated product dispensing container comprising:

a cylindrical body, a bottom wall and a valved cap to provide a container, an inverted cup shaped annular piston in said cylindrical body, said piston having an upper portion and a lower portion, said upper portion of said piston comprising a barrier wall shaped to conform to the inner top surface of said container, said barrier wall dividing said container into an upper product containing chamber and a lower propellant containing chamber, said lower portion of said piston depending from said upper portion and comprising a stepped annular sidewall having a plurality of annular sealing segments, a first one of said annular sealing segments being an upper segment having an outer diameter less than the inner diameter of said cylindrical body to provide an upper annular gap between said sidewall and cylindrical body, product loaded under pressure into said upper chamber of said container flowing at a relatively fast rate into said upper annular gap to stabilize said piston in said cylindrical body and to provide a seal between said upper sidewall segment and said cylindrical body, a second one of said annular sealing segments being a lower segment having an outer diameter less than the inner diameter of said cylindrical body to provide a lower annular gap between said sidewall and said cylindrical body, said lower annular gap being smaller than said upper annular gap, product flowing from said upper annular gap into said lower annular gap at a relatively slower rate to provide a seal in said lower annular gap between said lower sidewall segment and said cylindrical body.

2. The container of claim 1 wherein said stepped annular sidewall includes a third annular segment, said third segment being an intermediate segment having an outer diameter greater than said outer diameter of said upper annular segment and less than the outer diameter of said lower annular segment, to provide a third annular gap having a thickness intermediate between said upper annular gap and said lower annular gap.

3. The piston of claim 1 wherein said thickness of said upper annular gap is approximately four to five times said thickness of said lower annular gap.

4. The piston of claim 1 wherein the thickness of said upper annular gap is about 50 mils (1.25 mm) and the thickness of said lower annular gap is about 10 mils (0.25 mm).

5. The piston of claim 1 wherein the thickness of said upper annular gap is about 10 mils (0.25 mm) and the thickness of said lower annular gap is about 2 mils (0.05 mm).

6. The piston of claim 1 further comprising a plurality of spaced nibs extending down from the lower edge of said piston sidewall.

7. The piston of claim 2 further comprising a plurality of spaced nibs extending down from the lower edge of said piston sidewall.

* * * * *

UNITED STATES PATENT AND TRADEMARK OFFICE

CERTIFICATE OF CORRECTION

PATENT NO. : 4,913,323

DATED : April 3, 1990

INVENTOR(S) : Christian T. Scheindel

It is certified that error appears in the above-identified patent and that said Letters Patent is hereby corrected as shown below:

On title page, item

[73] Assignee: Scheindel Associates, Inc.,
Randolph Center, VT

Signed and Sealed this

Eighth Day of February, 1994

*Attest:*

*Attesting Officer*

Bruce Lehman

BRUCE LEHMAN

*Commissioner of Patents and Trademarks*